United States Patent [19]

Kodama

[11] Patent Number: 4,780,745

[45] Date of Patent: Oct. 25, 1988

[54] BOTH SIDE RECORDING APPARATUS

[75] Inventor: Yutaka Kodama, Tokyo, Japan

[73] Assignee: Ricoh Company, Ltd., Tokyo, Japan

[21] Appl. No.: 113,874

[22] Filed: Oct. 27, 1987

[30] Foreign Application Priority Data

Oct. 27, 1986 [JP] Japan ..... 61-253638

[51] Int. Cl.[4] ..... G03G 15/00

[52] U.S. Cl. ..... 355/14 SH; 355/24; 355/26; 355/3 SH; 271/270; 271/291; 271/186

[58] Field of Search ..... 355/23, 24, 26, 3 SH, 355/14 SH, 48, 50; 271/291, 202, 203, 270, 186

[56] References Cited

U.S. PATENT DOCUMENTS

| | | | |
|---|---|---|---|
| 4,110,025 | 8/1978 | Tabata | 355/24 X |
| 4,116,558 | 9/1978 | Adamek et al. | 355/24 |
| 4,170,349 | 10/1979 | Baumann | 271/270 X |
| 4,194,829 | 3/1980 | Cavagnaro | 355/24 X |
| 4,466,733 | 8/1984 | Pels | 355/24 X |
| 4,629,172 | 12/1986 | Kameyama et al. | 271/270 X |
| 4,676,499 | 6/1987 | Kimizuka et al. | 271/270 |
| 4,692,020 | 9/1987 | Tsujihara | 355/24 X |

*Primary Examiner*—R. L. Moses

*Attorney, Agent, or Firm*—Cooper & Dunham

[57] ABSTRACT

A both side recording apparatus for recording on both sides of a sheet of paper includes printer main body provided with an image forming device and a table provided with a feed-back path. In a one side print mode, a sheet of paper is fed from a cassette and it is temporarily halted by a registration roller, and then the sheet of paper is moved past a photosensitive drum to thereby have a toner image transferred from the drum to one side of the sheet of paper. Then, after having the toner image fixed to the sheet of paper, the sheet of paper is discharged onto a tray. In a both side print mode, after image fixing, the sheet of paper is routed to the feed-back path, so that the sheet of paper is inverted and again fed toward the registration roller. In accordance with the present invention, it is so structured that a sheet of paper is transported at an increased speed while being transported at least a part of the feed-back path.

12 Claims, 2 Drawing Sheets

BOTH SIDE RECORDING APPARATUS

BACKGROUND OF THE INVENTION

1. Field of the Invention

This invention generally relates to an apparatus for recording both sides of a sheet of recording medium, and, in particular, to a high-speed both side recording apparatus capable of recording a first image on one side of a sheet of recording paper and then recording a second image on the opposite side.

2. Description of the Prior Art

A both side recording apparatus is well known in the art. In such a both side recording apparatus, there is defined a first transportation path which extends from a paper supplying station to a paper discharging station and also a second transportation path having both ends connected to the first transportation path to thereby form a feed-back loop. An image transfer station is disposed along the first transportation path so that a toner image is transferred from an image forming device to a sheet of recording paper which is being transported along the first transportation path, and an image fixing station is also disposed along the first transportation path downstream of the image transfer station with respect to the direction of advancement of a sheet of recording paper. Thus, the toner image transferred to a sheet of recording paper becomes permanently fixed to the sheet as the sheet travels through the image fixing station. Also provided along the first transportation path is a registration roller which is driven to rotate intermittently in association with the operation of the image forming device.

The first end of the second transportation path is connected to the first transportion path at a first location upstream of the location where the registration roller is disposed, and the second end of the second transportation path is connected to the first transportation path at a second location downstream of the location where the image transfer station is located. Thus, a sheet of paper being transported back through the second transportation path travels through the image forming and fixing stations for the second time so that image may be formed on both sides of the sheet. A paper inversion station is normally provided in the second transportation path so that the sheet is fed into the first transportation path as being turned upside down when supplied into the first transportation path from the second transportation path.

In such a double side recording apparatus, it is typically so structured that a sheet of paper is transported at the same speed both in the first and second transportation paths. However, since a sheet of paper undergoes an inversion process while being transported along the second transportation path so as to be fed back into the first transportation path for forming a second image on the opposite side, it takes some time for the sheet of paper to become ready for forming a second image, which is one of the main causes of a low copying speed of a both side recording apparatus.

SUMMARY OF THE INVENTION

In accordance with the principle of the present invention, there is provided a both side recording apparatus including a first transportation path extending from a paper supplying station to a paper discharging station and a second transportation path having both ends connected to the first transportation path to thereby define a feed-back loop, whereby a sheet of paper is transported at different speeds between the first and second transportation paths. In the preferred embodiment, a sheet of paper is transported at a first speed while being transported through the first transportation path and at a second speed, which is higher than the first speed, while being transported through the second transportation path. It is also preferable to provide a separate driving source for driving transporting means disposed along the second transportation path.

It is therefore a primary object of the present invention to obviate the disadvantages of the prior art as described above and to provide an improved both side recording apparatus.

Another object of the present invention is to provide an improved high-speed both side recording apparatus capable of copying both sides of a sheet of recording medium at an increased speed.

A further object of the present invention is to provide an improved both side recording apparatus high in performance and reliable in operation.

A still further object of the present invention is to provide an improved both side recording apparatus simple in structure and low at cost.

Other objects, advantages and novel features of the present invention will become apparent from the following detailed description of the invention when considered in conjunction with the accompanying drawings.

DESCRIPTION OF THE PREFERRED EMBODIMENTS

Figure 1:
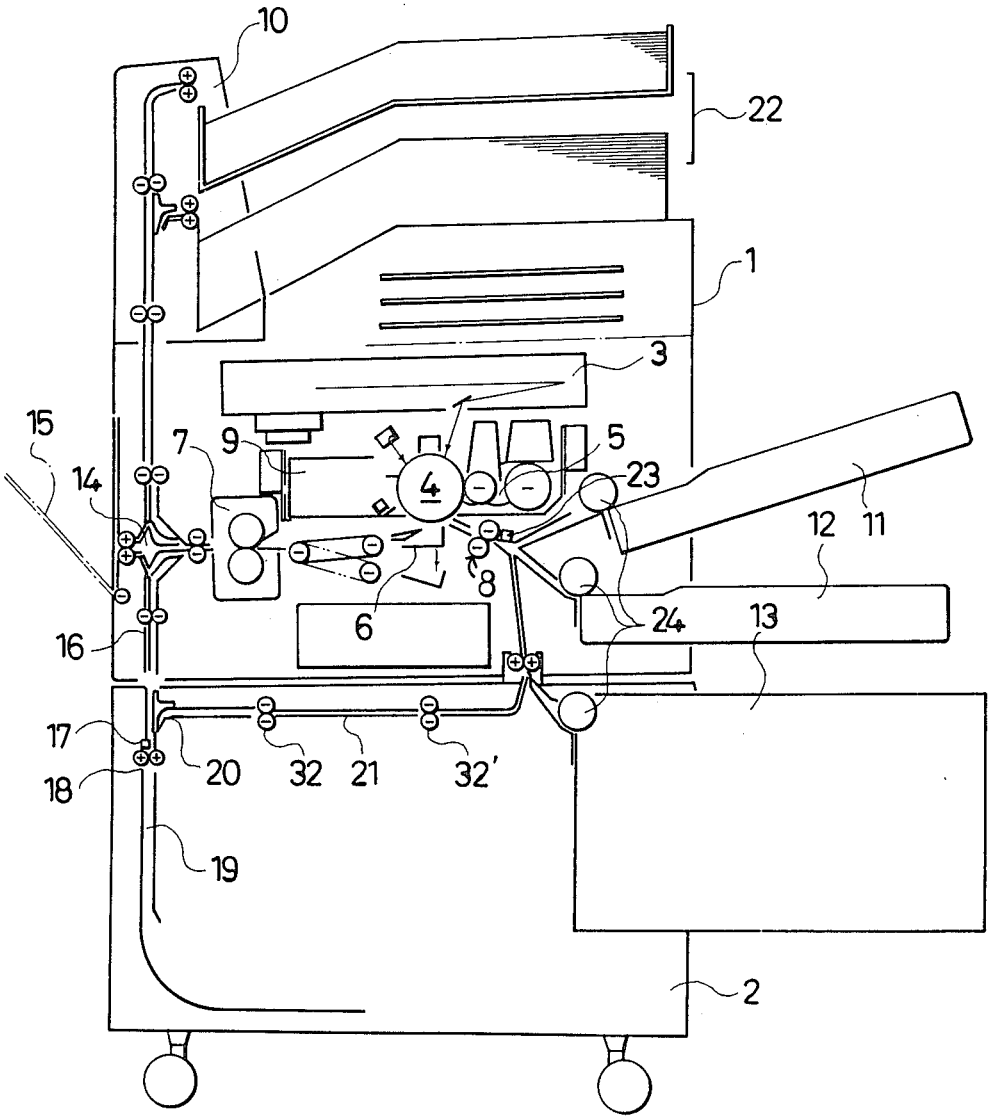
FIG. 1 is a schematic illustration showing the overall structure of a both side recording apparatus constructed in accordance with one embodiment of the present invention.

Referring now to FIG. 1, there is schematically shown a both side recording apparatus constructed in accordance with one embodiment of the present invention. As shown, the illustrated recording apparatus generally divided into an upper half, which defines a printer main body 1, and a lower half, which defines an optional table 2 for placing thereon the printer main body 1. The printer main body 1 is provided with a laser beam writing unit 3 and a photosensitive drum 4 which is rotatably supported and driven to rotate in a predetermined direction at constant speed. The printer main body 1 is also provided with a pair of upper and lower paper supplying or pick-up rollers 24, 24, and a pair of upper and lower paper cassettes 11 and 12, each storing therein a quantity of recording paper, is detachably mounted with their paper supplying end inserted into and located adjacent to the associated pick-up roller 24. An upper paper supplying path extends from the upper pick-up roller 24 to a registration roller 8, and a lower paper supplying path extends from the lower pick-up roller 24 to the registration roller 8.

A registration roller 8 is driven to rotate intermittently in association with the rotation of the photosensitive drum 4 such that when a sheet of paper is transported from the registration roller 8 a toner image formed on the photosensitive drum 4 may be transferred to a proper position on the sheet of paper. As is well known in the art, as the drum 4 rotates, its surface is charged uniformly and then a light beam carrying image information is irradiated onto the drum from the laser beam writing unit 3, so that the charge uniformly charged on the drum 4 is selectively dissipated to thereby define an electrostatic latent image, which, in turn, is developed by a developing device 5 to thereby define a toner image on the drum 4. The toner image thus formed on the drum 4 is then transferred to a sheet of paper transported by the registration roller 8 in a predetermined timing at an image transfer station 6. After image transfer, any residual toner on the drum 4 is removed by a cleaning unit 9 to thereby make the drum 4 available for the next cycle of imaging operation.

A common paper transporting path extends from the registration roller 8 through an image transfer station to an image fixing station when an image fixing unit 7 is disposed. Thus, while a sheet of paper is being transported along the common paper transporting path, a toner image is transferred from the drum 4 and the thus transferred toner image is permanently fixed to the sheet. A path switching pawl 14 is disposed at the exit of the image fixing unit 7, and a first discharging path extends from the path switching pawl 14 to a face-up discharge tray 15 and a second discharging path extends from the path switching pawl 14 to a face-down tray 22. In addition, a third discharging path, which defines part of a feed-back loop, extends from the path switching pawl 14 to a feed-back path defined in the optional table 2. The feed-back transportation path includes an inversion station where a sheet of paper having one side recorded is turned upside down and the inversion station is defined by an inversion roller 18 and an inversion guide 19. The feed-back path extends to a location where it merges with a third paper supplying path extending from a third pick-up roller 24 is disposed at the supplying port of a large volume paper supplying unit 13. A third paper supplying path extends from the merging point to the registration roller 8.

Therefore, in the structure shown in FIG. 1, a first transportation path is defined as extending from a paper supplying unit, i.e., one of paper storing units 11, 12 and 13, to a paper discharging unit, i.e., one of trays 15 and 22, and a second transportation path is defined as having both ends connected to the first transportation path as a feed-back loop. In the illustrated structure, the second transportion path has a first end connected to the first transportation path at a first location upstream of the registration roller with respect of the direction of advancement of a sheet of paper and a second end connected to the first transportation path at a second location downstream of the imaging fixing unit 7.

In operation, in a one-side print mode, a sheet of recording paper supplied as picked up by a pick-up roller 24 of a selected one of the paper storing units 11 through 13 advances toward the registration roller 8, and when the leading edge of the sheet of paper is detected by a registration detector 23 disposed immediately in front of the registration roller 8, the transportation of the sheet of paper is temporarily halted with the leading edge of the sheet of paper in abutment against the registration roller 8 which is held stationary. Thus, the sheet of paper becomes somewhat bent because its leading edge is in abutment against the registration roller 8 which is not in rotation, whereby any skew of the sheet of paper is corrected. Then, in synchronism with the rotation of the photosensitive drum 4, the registration roller 8 is driven to rotate, so that the sheet of paper so far being held stationary is transported toward the drum 4. As the sheet of paper is being transported past the drum 4, the toner image formed on the drum 4 is transferred onto one side surface of the sheet of paper. The sheet of paper having thereon the transferred image at its one side surface is then moved past the image fixing unit 7, whereby the transferred toner image is permanently fixed to the sheet of paper.

After image fixing, the sheet of paper comes to the path switching pawl 14, from where the sheet of paper is either transported to the face-up tray 15 where the sheet of paper is stacked with its side surface having thereon the thus transferred image facing upward or transported to the face-down tray 22 where the sheet of paper is stacked with its side surface having thereon the thus transferred image facing downward. A paper discharging port 10 is defined at the top end of the paper discharging path extending vertically upward from the path switching pawl 14.

On the other hand, in the case of a both side recording mode, the process steps up to the image fixing operation remain the same; however, after image fixing at a first side surface of the sheet of paper, the sheet of paper is caused to travel into the feed-back transportation path 21 by the path switching pawl 14, so that the sheet of paper advances downward from the path switching pawl 14 by means of transportation rollers 16 to thereby enter into the feed-back path 21 defined in the optional table 2. The feed-back path 21 includes a paper inversion station defined by the inversion roller 18 and the inversion guide 19 which extends downward as an extension of the path section extending downward from the path switching pawl 14. The inversion guide 19 has such a length which is sufficiently long to handle a maximum-sized sheet of paper useable with the present recording apparatus. An inversion detector 17 is also provided immediately in front of the inversion roller 18. A pivotal inversion pawl 20 is also provided in front of the inversion roller 18. With this structure, in a dual recording mode, the sheet of paper whose first side surface has been recorded is transported by the transportation roller 16 and the leading edge of this sheet of paper is detected by the inversion detector 17. The sheet of paper is halted after having been transported for a predetermined time period, which is determined depending on the size of the sheet of paper selected, upon detection by the inversion detector 17. Then, the inversion pawl 20 is pivotted and the inversion roller 18 is driven to rotate in the reversed direction so that the sheet of paper is now caused to advance with its former trailing edge as a new leading edge into the feed-back path 21. Thus, the sheet is transported by transportation rollers 32 and 32' as being upside down. The sheet of paper again comes to a temporary halt when its leading edge comes into abutment against the registration roller 8. Then, in association with the rotation of the drum 4, the registration roller 8 is driven to rotate to thereby cause the sheet of paper to be transported along the path through the image transferring and fixing stations, so that a second image is now formed on the second side surface of the sheet of paper. After image fixing, the sheet of paper is now discharged out onto the tray 15 or 22, as desired.

In accordance with the principle of the present invention, it is so structured that a sheet of paper is transported at a first speed while being transported along the first transportation path, e.g., while being transported through the image transfer and fixing stations, and at a second speed, which is different from and preferably higher than the first speed, while being transported along the second or feed-back transportation path 21. Thus, in accordance with the present invention, since a sheet of paper may be transported at different speeds through the first and second transportation paths, there is an increased degree of freedom in designing the overall structure of the present recording apparatus. In particular, when it is so structured that a sheet of paper is transported at a higher speed while being transported along the second or feed-back transportation path, the overall speed of both side recording operation is significantly increased.

In the preferred embodiment of the present invention, provision is made of a pulse motor, which may be driven either in the normal direction or in the reversed direction and which may vary its speed easily, as a driving source for driving the movable parts provided in the optional table 2 as separately from a main driving source for driving various components provided in the printer main body 1. As well known in the art, it is so structured that the size of a sheet of paper selected for use has been detected and stored in a controller, such as a CPU. Thus, during the both side recording mode, when the leading edge of a sheet of paper whose first side surface has been recorded has been detected by the inversion detector 17, a command is supplied from the CPU to the pulse motor upon elapsing of a predetermined time period which varies depending on the size of the sheet of paper in use so as to allow the trailing edge of the sheet of paper in use to move past the last transportation roller 16 in the printer main body 1. Upon receipt of the command, the pulse motor starts to rotate at an increased speed, so that the transportation speed through the feed-back path 21 is set higher than the transportation path through the first path in the printer main body 1.

When the sheet of paper has been moved into the inversion guide 19 sufficiently with its tailing edge moved past the inversion pawl 20, the pulse motor is temporarily halted so that the sheet of paper is also stopped. Then, the inversion pawl 20 is pivotted to connect the inversion station to the feed-back path 21. And, then, the pulse motor is driven to rotate in the reversed direction so that the sheet of paper now residing in the inversion station starts to move in the opposite direction with its former trailing edge now defined as its leading edge. As a result, the sheet of paper moves out of the inversion station and enters into the feed-back path 21 as driven by the transportation rollers 32 and 32'. The sheet of paper is again stopped when its leading edge comes into abutment against the registration roller 8. Then, in association with the rotation of the drum 4, the registration roller 8 is again driven to rotate to have the sheet of paper move through the image transfer and fixing stations for the second time and with its second surface facing upward. At the same time, the pulse motor as a driving source in the optional table 2 is switched back to the original driving speed.

As described above, in accordance with the present invention, the transportation speed at the feed-back path 21 is switched between high and low speeds. In one example, it may be so structured that the transportation speed is set at the same speed between the printer main body 1 and the optional table 2 while a sheet of paper is being transported as commonly driven by rollers of the printer main body 1 and the optional table 2 and the transportation speed at the optional table 2 is set at a higher speed while a sheet of paper is driven to move only by those rollers provided in the optional table 2. With this structure, since a sheet of paper is transported acceleratedly while being transported through the feed-back path, the overall recording speed for recording both sides of a sheet of paper is increased.

The operating conditions of various components disposed in the printer main body 1, such as laser beam writing device 3, developing unit 5, image transfer unit 6, image fixing unit 7 and cleaning unit 9, have been determined in accordance with a predetermined paper transportation speed, and, therefore, it is extremely difficult to change the paper transportation speed in the printer main body 1. On the contrary, such constraints are not existent in the optional table 2 because it only includes the large volume paper storing unit 13 and the feed-back transportation path 21, so that the paper transportation path through the feed-back path 21 may be varied relatively easily.

As an example, in the structure illustrated in FIG. 1, it may be so structured that the paper transportation speed in the table 2 is increased after the trailing edge of a sheet of paper has moved past the last transportation roller 16 in the printer main body 1 until the sheet of paper, after having been inverted, comes to be stopped with its leading edge abutting against the registration roller 8. In this case, if it is desired to obtain the performance of 20 ppm (prints per minute) for A4-sized sheets of paper with the one side print mode and vertical transportation, i.e., a sheet of paper being transported with its longitudinal side maintained perpendicular to the direction of transportation, the paper transportation speed must be set approximately at 90 mm/s. If the paper transportation speed in the feed-back path 21 is also set at 90 mm/s for the both side print mode, then the overall printing speed in the both side print mode will be approximately 7.5 ppm. On the other hand, if the paper transportation speed in the feed-back path 21 is set at an increased speed ranging between 150 to 160 mm/s in accordance with the principle of the present invention, then the overall printing speed in the both side print mode will be approximately 10 ppm.

It is to be noted that the timing to increase the paper transportation speed may be set arbitrarily as long as it is set after the trailing edge of a sheet of paper has moved past the last transportation roller 16 of the printer main body 1. For example, as another example, the paper transportation speed in the optional table 2 may be increased when a sheet of paper is going to be transported reversibly, i.e., with its former trailing edge converted to a leading edge, after the sheet of paper has been brought to a halt as being inserted into the inversion guide 19. Such a structure is advantageous because the switching in the level of transportation speed can be carried out while the driving source or sources and the transportation rollers are motionless, so that a high speed switching operation can be carried out securely.

Figure 2:
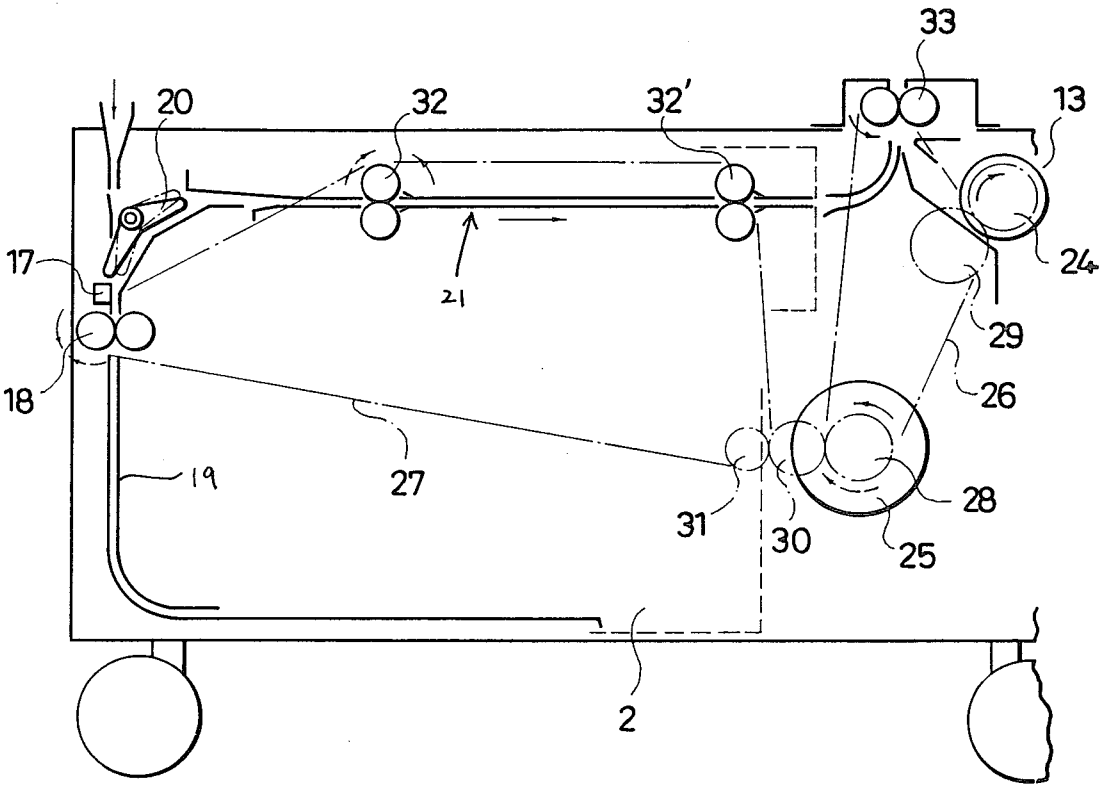
FIG. 2 is a schematic illustration showing the structure of an embodiment of the present invention, in which a driving source is commonly used for driving a large quantity paper supplying unit and transportation rollers of a feed-back path for feeding back a sheet of paper to a recording station for the second time.

As a further embodiment, a driving source provided in the optional table 2 separately from the main driving source (not shown) provided in the printer main body 1 for driving the large volume paper supplying unit 13 may be commonly used as a driving source for driving the rollers 18, 32 and 32' provided along the feed-back path 21 defined in the optional table 2. Because the optional table 2 is only provided with the large volume paper supplying unit 13 and the feed-back path 21, and either one of the unit 13 and the path 21 supplies a sheet of paper toward the registration roller 8 one at a time. FIG. 2 shows a schematic illustration showing such an example using a driving source commonly for the large volume paper supplying unit 13 and the feed-back path 21. As shown in FIG. 2, there is provided a variable-speed, reversible motor 25 in the optional table 2 as a common driving source for the large volume paper supplying unit 13 and the feed-back path 21.

When the motor 25 rotates counterclockwise, a gear mounted drive pulley 28 fixedly mounted on a motor shaft of the motor 25 also rotates counterclockwise. Thus, through engagement between teeth provided in the inner surface of a serrated belt 26 and the gear of the drive pulley 28, the belt 26 is driven to rotate counterclockwise, so that a follower pulley 29 is also driven to rotate counterclockwise. A gear is formed integrally with the follower pulley 29 and it is in mesh with a gear provided on a shaft of the pick-up roller 24 on the large volume paper supplying unit 13. As a result, the shaft of the pick-up roller 24 is driven to rotate clockwise. An electromagnetic clutch is interposed between the pick-up roller 24 and its associated shaft, and when the clutch is activated by a paper supply signal, the pick-up roller 24 is coupled to its associated shaft so that it starts to rotate clockwise to thereby have a sheet of paper fed into the paper supplying path.

On the other hand, the gear of the drive pulley 28 is in mesh with an idle gear 30 which in turn is in mesh with a sprocket gear 31. A chain 27 extending around the sprocket gear 31 is operatively associated with the inversion roller 18 and the transportation rollers 32 and 32' provided along the feed-back path 21, so that these rollers 18, 32 and 32' are all driven to rotate clockwise. As a result, a sheet of paper entering into the table 2 is led into the inversion path or guide 19. In this case, the inversion switching lever 20 takes the position indicated by the one-dotted line so that the sheet of paper entering into the table 2 may be smoothly led into the inversion path or guide 19. The leading edge of the sheet of paper is detected by the inversion detector 17, and, thus, the motor 25 is stopped after elapsing a predetermined time period which has been determined in advance in relation to the size of the sheet of paper in use. The sheet of paper is brought to a halt temporarily as inserted in the inversion guide 19 with its trailing edge clearing past the bottom end of the inversion switching lever 20. Then, the inversion switching lever 20 is pivotted clockwise to take the position indicated by the solid line to thereby block the path toward the roller 16 but define a path toward the registration roller 8 instead.

Thereafter, the motor 25 is driven to rotate in the reversed direction or in the clockwise direction as indicated by the dotted line at an increased speed. Thus, the sheet of paper now residing in the inversion guide 19 starts to move in the reversed direction, i.e., with its former trailing edge now defined as a leading edge, and the sheet of paper is led into the horizontal section of the feed-back path 21 as guided by the inversion switching lever 20. Accordingly, the sheet of paper is now transported by the transportation rollers 32, 32' and 33 and it comes to a halt when its leading edge comes into abutment against the registration roller 8 It is to be noted that the transportation roller 33 is driven by the motor 25 through the serrated belt 26 so that the roller 33 is also driven to rotate at the increased speed.

It is to be noted that even if the motor 25 is driven to rotate in the reversed direction as described above, since an electromagnetic clutch is provided between the pick-up roller 24 and its associated shaft, the pick-up roller 24 remains motionless so that the pick-up roller 24 is prevented from being driven to rotate in the unwanted reversed direction. In addition, when a sheet of paper is fed from the large volume paper supplying unit 13, the motor 25 is driven to rotate in the normal direction as indicated by the solid line arrow, and the electromagnetic clutch is activated to couple the pick-up roller 13 to its associated shaft. Thus, the pick-up roller 13 rotates clockwise to have a sheet of paper fed into the paper supplying path. In this case, the rollers 18, 32, 32' are also driven to rotate at the same time; however, since no sheet of paper is present in the feed-back path when supplying a sheet of paper from the large volume paper supplying unit 13 to the registration roller 8, no problem arises. Thus, the rollers 18, 32 and 32' may be left driven to rotate in the reversed direction while supplying a sheet of paper from the large volume paper supplying unit 13 to the registration roller 8. However, if desired, a clutch may be provided or the idler roller 30 may be provided shiftable in position to decouple the motor 25 from the chain 27 when the motor 25 is driven to rotate in the normal direction. As a further alternative, a clutch may be provided in the sprocket gear 31 so as to decouple the driving connection between the motor 25 and the chain 27. Such a structure is advantageous because it will contribute to reduce noise level and wear of parts. Moreover, such a structure is required when one or more sheets of paper is present in the feed-back path 21 while supplying a sheet of paper from the large volume paper supplying unit 13.

While the above provides a full and complete disclosure of the preferred embodiments of the present invention, various modifications, alternate constructions and equivalents may be employed without departing from the true spirit and scope of the invention. For example, the present invention may be applied to any type of recording apparatuses other than the one using a laser beam printer. Therefore, the above description and illustration should not be construed as limiting the scope of the invention, which is defined by the appended claims.

What is claimed is:

1. A recording apparatus comprising:

a first paper transportation path extending from at least one paper supplying station to at least one paper discharging station;

first transporting means for transporting a sheet of paper through said first paper transportion path;

image forming means disposed at an image forming station located at said first paper transportation path between said at least one paper supplying station and said at least one paper discharging station for forming an image on one side of said sheet of paper;

a second paper transportation path extending between a first connection point located at said first paper transportation path between said image forming station and said at least one paper discharging station and a second connection point at said first paper transporting path between said at least one paper supplying station and said image forming station to thereby define a feed-back loop;

second transporting means for transporting a sheet of paper along said second paper transportation path; and control means for controlling the speed of transportion of a sheet of paper such that a sheet of paper is transported at a first speed while being transported through said first paper transportation path and a sheet of paper is transported at a second speed, which is faster than said first speed, while being transported through at least part of said second transportation path.

2. The recording apparatus of claim 1, wherein said image forming means including a photosensitive drum which is driven to rotate in a predetermined direction at constant speed, whereby a toner image formed on said drum is transferred to one side of a sheet of paper being transported through said first paper transportation path, and a registration roller is disposed at said second connection point, said registration roller being driven to rotate intermittently in association with the rotation of said photosensitive drum.

3. The recording apparatus of claim 2, wherein said image forming means further includes an image fixed unit disposed downstream of said photosensitive drum with respect to the direction of advancement of a sheet of paper through said first paper transportation path for causing said toner image transferred to said sheet of paper to be permanently fixed thereto.

4. The recording apparatus of claim 1, further comprising path controlling means at said first connection point for automatically connecting or disconnecting said first paper transportation path to or from said second paper transportation path.

5. The recording apparatus of claim 4, wherein said second paper transportation path includes inverting means for inverting the direction of movement of a sheet of paper such that the sheet of paper is inverted to move with its former trailing edge as a leading edge.

6. The recording apparatus of claim 1, wherein said first transporting means includes a plurality of first rollers disposed along said first paper transportation path and said second transporting means includes a plurality of second rollers disposed along said second paper transportation path.

7. The recording apparatus of claim 6, wherein said recording apparatus is divided into an upper section and a lower section, a part of said second paper transportation path being defined in said lower section and the rest of said second paper transportation path and said first paper transportation path being defined in said upper section.

8. The recording apparatus of claim 7, wherein a separate driving source is provided in said lower section and those of said plurality of second rollers provided in said lower portion are operatively associated with said separate driving source.

9. The recording apparatus of claim 8, wherein said separate driving source is a speed-variable, reversible motor which may rotate at different speeds and which may rotate in the reversed direction.

10. The recording apparatus of claim 8, wherein said lower section is provided with a large volume paper supplying unit which is also operatively associated with said separate driving source and said large volume paper supplying unit includes a paper supplying path which merges into said second paper transportation path, thereby defining a common path section leading to said second connection point.

11. The recording apparatus of claim 8, wherein said control means causes a sheet of paper to be transported at said second speed when the sheet of paper comes to be transported only by those of said plurality of second rollers associated with said separate driving source.

12. The recording apparatus of claim 5, wherein said control means causes a sheet of paper to be transported at said second speed after said sheet of paper has been inverted by said inverting means.

* * * * *